US008054269B2

(12) United States Patent
Huang

(10) Patent No.: US 8,054,269 B2
(45) Date of Patent: Nov. 8, 2011

(54) ELECTRONIC DEVICE FOR ENHANCING VOLTAGE DRIVING EFFICIENCY FOR A SOURCE DRIVER AND LCD MONITOR THEREOF

(75) Inventor: Li-Chun Huang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 630 days.

(21) Appl. No.: 12/204,807

(22) Filed: Sep. 5, 2008

(65) Prior Publication Data

US 2010/0013749 A1 Jan. 21, 2010

(30) Foreign Application Priority Data

Jul. 18, 2008 (TW) ..... 97127316 A

(51) Int. Cl.
*G09G 3/36* (2006.01)

(52) U.S. Cl. ..... 345/89; 345/690

(58) Field of Classification Search ..... 345/89, 345/690

See application file for complete search history.

(56) References Cited

U.S. PATENT DOCUMENTS 6,259,472 B1 * 7/2001 Park ..... 348/28
7,701,474 B2 * 4/2010 Hashimoto ..... 345/690
7,733,312 B2 * 6/2010 Moon et al. ..... 345/87

* cited by examiner

*Primary Examiner* — Chanh Nguyen
*Assistant Examiner* — Roy Rabindranath
(74) *Attorney, Agent, or Firm* — Winston Hsu; Scott Margo

(57) ABSTRACT

An electronic device for enhancing voltage driving efficiency for a source driver and a liquid crystal display (LCD) monitor is disclosed. The electronic device includes a reference voltage generator, a plurality of first coupling lines, a second coupling line wider than the first coupling lines, a data statistical unit and a reference voltage modulating module. The reference voltage generator generates a plurality of grayscale reference voltages. Each first coupling line and the second coupling line are utilized for transmitting one of the grayscale reference voltages. The data statistic unit statistically calculates a plurality of grayscale data values to generate a statistical result indicating a grayscale reference voltage corresponding to the most of the grayscale data values among the grayscale reference voltages. The reference voltage modulating module adjusts transmission relationship between the grayscale reference voltages and the first coupling lines and the second coupling line according to the statistic result.

31 Claims, 7 Drawing Sheets

ELECTRONIC DEVICE FOR ENHANCING VOLTAGE DRIVING EFFICIENCY FOR A SOURCE DRIVER AND LCD MONITOR THEREOF

BACKGROUND OF THE INVENTION

1. Field of the Invention

The present invention relates to an electronic device for enhancing voltage driving efficiency for a source driver and a liquid crystal display (LCD) monitor thereof, and more particularly to an electronic device and a LCD monitor thereof for enhancing efficiency of driving grayscale reference voltages to reduce total charging time for equivalent capacitance units.

2. Description of the Prior Art

A liquid crystal display (LCD) monitor featuring slim design, low power consumption, and no radiation pollution has been applied widely to a computer system, a mobile phone, a Personal Digital Assistant (PDA) and so on. The operation principle of a LCD monitor is based on different alignments of liquid crystal molecules with different effects of polarization and deflection. By means of different alignments of the liquid crystal molecules, the light can be allowed to pass through in varying amount, thus constituting different intensities of the emitting light and different levels of grayscales in red, blue and green.

Please refer to FIG. 1, which is a schematic diagram of a thin film transistor (TFT) LCD monitor 10 according to the prior art. The LCD monitor 10 includes an LCD panel 100, a timing control circuit 102, a data line output circuit 104, and a scan line output circuit 106. The LCD panel 100 includes two substrates with liquid crystal material in between. One substrate has a plurality of data lines 110, a plurality of scan lines (gate lines) 112 perpendicular to the data lines 110, and a plurality of TFTs 114. For convenient explanation, only four TFTs 114 are shown in FIG. 1. There exists one TFT 114 at every intersection of each of the plurality of data lines 110 and scan lines 112 in practice. In other words, the TFTs 114 are distributed on the LCD panel 100 in matrix. Each data line 110 corresponds to a column of the LCD monitor 100, each scan line 112 corresponds to a row of the LCD monitor 10, and each TFT 114 corresponds to a pixel. Furthermore, the circuit characteristic of the two substrates of the LCD monitor corresponding to each pixel is regarded as an equivalent capacitance unit 116.

In the LCD monitor 10, the timing control circuit 102 generates input signals to the data line output circuit 104 and the scan line output circuit 106, respectively. The scan line output circuit 106 inputs a pulse into the scan lines 112 to conduct the TFTs 114, and thereby voltage signals driven from the data line output circuit 104 to the data lines 110 can be transmitted to the equivalent capacitance units 116 through the TFTs 114 to control the gray level status of the corresponding pixel.

As the LCD monitor 10 is a large size monitor, the data line output circuit 104 usually includes multiple source drivers. Each source driver is responsible for signal output to data lines 110. The main function of the source drivers is to transfer the received digital grayscale data into analog driving voltages and perform Gamma correction, driving voltage polarity control, etc.

Please refer to FIG. 2, which is an internal schematic diagram of a source driver 20 of the data line output circuit 104 shown in FIG. 1. A LCD panel 26 coupled to the source driver 20 can display 64 levels of grayscales (denoted by values 0-63). The source driver includes a reference voltage generator 22, a data latch 24, digital to analog converters (DACs) DAC(1)-DAC(640), coupling lines L1-L64 and operational amplifiers (OPs) OP(1)-OP(64). The data latch 24 is utilized to receive 6 bits (capable of representing grayscale values from 0 to 63) grayscale data values GD0-GD63 which correspond to DAC (1)-DAC (640) and equivalent capacitances C1-C64 on the LCD panel 26 respectively. The reference voltage generator 22 generates grayscale reference voltages GV0-GV63 which are regarded as Gamma correction voltages when the source driver 20 equipped with the Gamma correction function. The OP (1)~OP (64) drive the grayscale reference voltages GV0-GV63 to feed DAC (1)-DAC (640) through the coupling lines L1-L64, respectively. For simplicity, assume that the voltage gain of OP (1)~OP (64) is equal to 1. Based on GD0~GD639, DAC (1)~DAC (640) select the corresponding coupling lines to output the corresponding reference voltages to the equivalent capacitances C1-C640. For example, if grayscale data values GD0 and GD1 are 32 and 63 respectively, the DAC (1) and DAC (2) selects the coupling lines L33 and L64 to output the grayscale reference voltages GV32 and GV63.

As mentioned above, when more DACs receive the same grayscale reference data, the coupling line corresponding to the grayscale reference data is selected by the DACs at the same time. This makes the corresponding OP's loading heavier such that it is hard to drive the grayscale reference voltages. More charging time will be needed for the equivalent capacitances, resulting in decrease of the displaying efficiency.

SUMMARY OF THE INVENTION

It is therefore an objective of the present invention to provide an electronic device for enhancing voltage driving efficiency for a source driver and liquid crystal display (LCD) monitor thereof.

The present invention discloses an electronic device for enhancing voltage driving efficiency for a source driver of an LCD monitor. The electronic device comprises a reference voltage generator, a plurality of first coupling lines, a second coupling line, a data statistical unit and a reference voltage modulating module. The reference voltage generator is used for generating a plurality of grayscale reference voltages. Each of the plurality of first coupling lines is used for transmitting one of the plurality of grayscale reference voltages. The second coupling line is used for transmitting one of the plurality of grayscale reference voltages. A width of the second coupling line is wider than a width of the plurality of first coupling lines. The data statistical unit is used for statistically calculating a plurality of grayscale data values to generate a statistic result which indicates a grayscale reference voltage corresponding to the most of the plurality of grayscale data values among the plurality of grayscale reference voltages. The reference voltage modulating module is coupled between the reference voltage generator and the plurality of first coupling lines and the second coupling line, and used for adjusting transmission relationship between the plurality of grayscale reference voltages and the plurality of first coupling lines and the second coupling line according the statistic result to transmit the grayscale reference voltage corresponding to the most of the plurality of grayscale data values through the second coupling line.

The present invention further discloses a method for enhancing voltage driving efficiency for a source driver of an LCD monitor. The method comprises the following steps. a plurality of first coupling lines and a second coupling line are provided. Each of the plurality of first coupling lines and the second coupling line are used for transmitting one of a plurality of grayscale reference voltages. A width of the second coupling line is wider than a width of the first coupling line. a plurality of grayscale data values are statistically calculated to generate a statistic result indicating a grayscale reference voltage corresponding to the most of the plurality of grayscale data values among the plurality of grayscale reference voltages. Transmission relationship between the plurality of grayscale reference voltages and the plurality of first coupling lines and the second coupling line is adjusted according the statistic result to transmit the grayscale reference voltage corresponding to the most of the plurality of grayscale data values through the second coupling line.

The present invention further discloses a LCD monitor for enhancing voltage driving efficiency. The LCD monitor comprises: a panel and a source driver coupled to the panel. The panel comprises a plurality of equivalent capacitance units and is capable of displaying a plurality of grayscales. The source driver comprises a reference voltage generator, a plurality of Operational Amplifiers (OPs), a plurality of first coupling lines, a second coupling line, a data statistical unit, a data modulating unit, a reference voltage modulating module, and a plurality of Digital to Analog Converts (DACs). The reference voltage generator is used for generating a plurality of grayscale reference voltages. The plurality of OPs is used for driving the plurality of grayscale reference voltages. Each of the first coupling lines is coupled to one of the plurality of Ops, and used for transmitting one of the plurality of grayscale reference voltages. The second coupling line is coupled to one of the plurality of Ops, and used for transmitting one of the plurality of grayscale reference voltages. A width of the second coupling line is wider than a width of the first coupling line. The data statistical unit is used for statistically calculating the plurality of grayscale data values corresponding to the plurality of equivalent capacitance units to generate a statistic result which indicates a grayscale reference voltage, corresponding to the most of the plurality of grayscale data values among the plurality of grayscale reference voltages, and corresponding grayscale data value. The data modulating unit is coupled to the data statistical unit, and used for adjusting the plurality of grayscale data values to output a plurality of modulated grayscale data values. The reference voltage modulating module is used for adjusting transmission relationship between the plurality of grayscale reference voltages and the plurality of first coupling lines and the second coupling line according to the statistic result to transmit the grayscale reference voltage corresponding to the most of the plurality of grayscale data values through the second coupling line. The plurality of DACs is coupled in sequence via the plurality of first coupling lines and the second coupling line. Each of the plurality of DACs is used for selecting one of the plurality of first coupling lines or the second coupling line according to one of the plurality of modulated grayscale data values to output corresponding grayscale reference voltage to one of the plurality of equivalent capacitance units. Among the plurality of DACs, a DAC corresponding to the grayscale reference voltage corresponding to the most of the plurality of grayscale data values selects the second coupling line according to corresponding grayscale modulated data value.

The present invention further discloses an LCD monitor for enhancing voltage driving efficiency. The LCD monitor comprises a panel and a source driver couple to the panel. The panel comprises a plurality of equivalent capacitance units and is capable of displaying a plurality of grayscales. The source driver comprises a reference voltage generator, a plurality of OPs, a plurality of first coupling lines, a second coupling line, a third coupling line, a data statistical unit, a data modulating unit, a reference voltage modulating module, and a plurality of DACs. The reference voltage generator is used for generating a plurality of grayscale reference voltages. The plurality of OPs is used for driving the plurality of grayscale reference voltages. Each of the first coupling lines is coupled to one of the plurality of OPs, and used for transmitting one of the plurality of grayscale reference voltages. The second coupling line is coupled to one of the plurality of OPs, and used for transmitting one of the plurality of grayscale reference voltages. A width of the second coupling line being wider than a width of the first coupling line. The third coupling line is couple to one of the plurality of OPs, and used for transmitting one of the plurality of grayscale reference voltages. A width of the third coupling line is wider than the width of the first coupling lines. The data statistical unit is used for statistically calculating the plurality of grayscale data values corresponding to the plurality of equivalent capacitance units to generate a statistic result which indicates two grayscale reference voltage, corresponding to the most and the second most of the plurality of grayscale data values among the plurality of grayscale reference voltages respectively, and corresponding grayscale data values. The data modulating unit is coupled to the data statistical unit, and used for adjusting the plurality of grayscale data values to output a plurality of the modulated grayscale data values. The reference voltage modulating module is used for adjusting transmission relationship between the plurality of grayscale reference voltages and the plurality of first coupling lines, the second coupling line, and the third coupling line according to the statistic result to transmit the grayscale reference voltage corresponding to the most of the plurality of grayscale data values through the second coupling line and the grayscale reference voltage corresponding to the second most of the plurality of grayscale data values through the third coupling line. The plurality of DACs is coupled in sequence via the plurality of first coupling lines, the second coupling line, and the third coupling line. Each of the plurality of DACs is used for selecting one of the plurality of first coupling lines, the second coupling line, or the third coupling line according to one of the plurality of modulated grayscale data values to output corresponding grayscale reference voltage to one of the plurality of equivalent capacitance units. Among the plurality of DACs, a DAC, corresponding to the grayscale reference voltage corresponding to the most of the plurality of grayscale data values, selects the second coupling line according to corresponding modulated grayscale data value. In addition, a DAC, corresponding to the grayscale reference voltage corresponding to the second most of the plurality of grayscale data values, selects the third coupling line according to corresponding modulated grayscale data value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
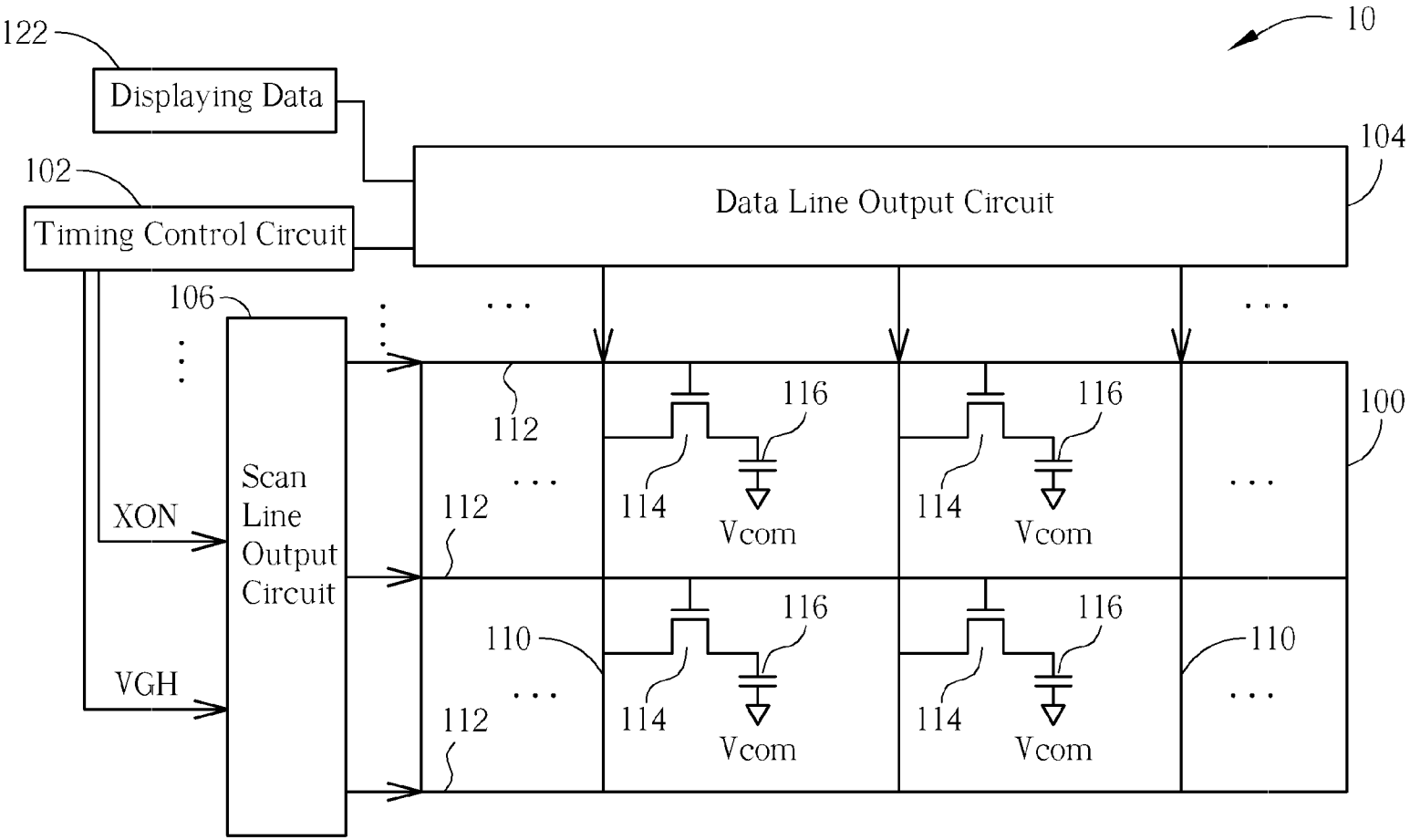
FIG. 1 PRIOR ART
FIG. 1 is a schematic diagram of a thin film transistor (TFT) according to the prior art.
Figure 2:
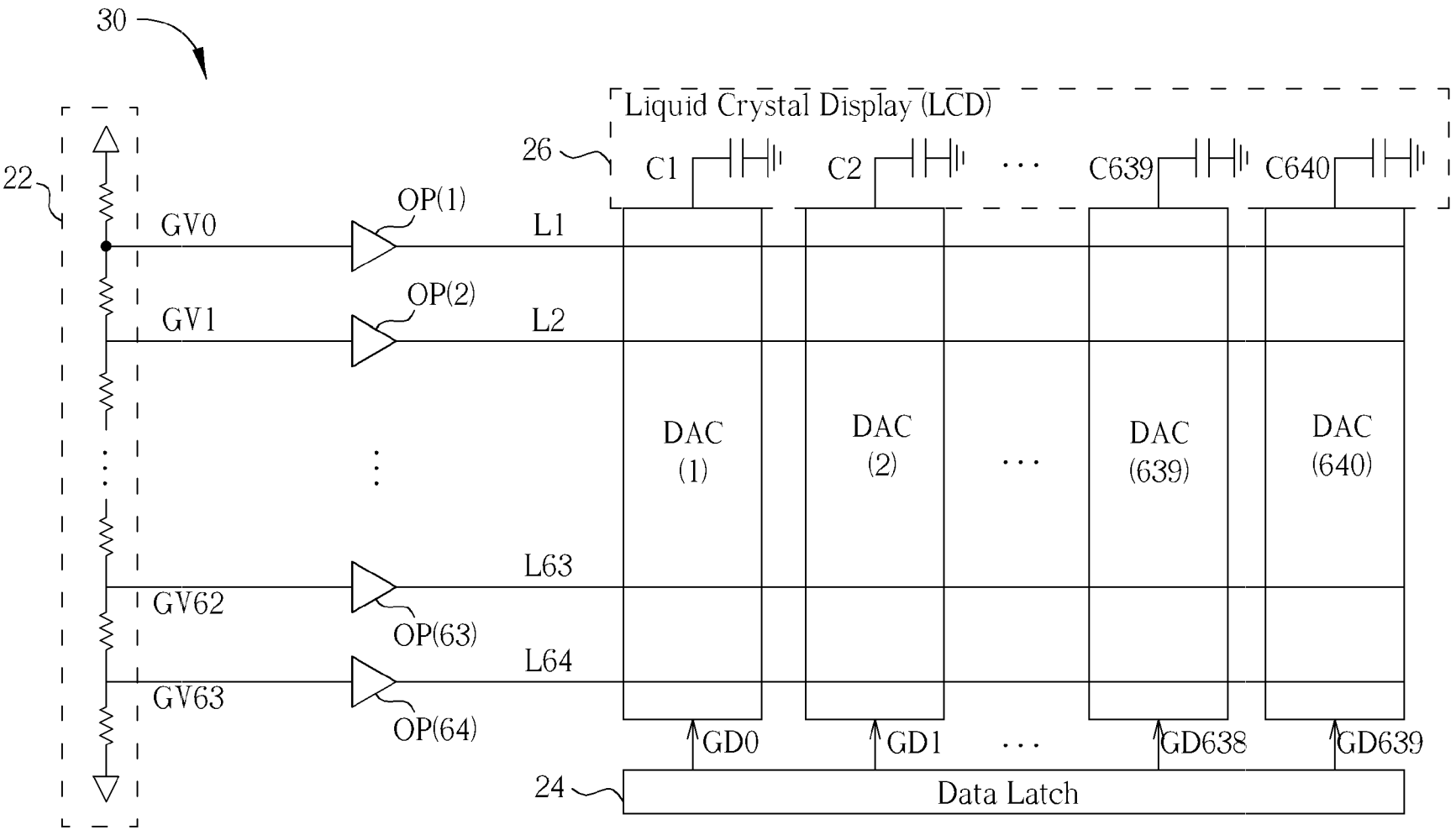
FIG. 2 PRIOR ART
FIG. 2 is an internal schematic diagram of a source driver according to the prior art.
Figure 3:
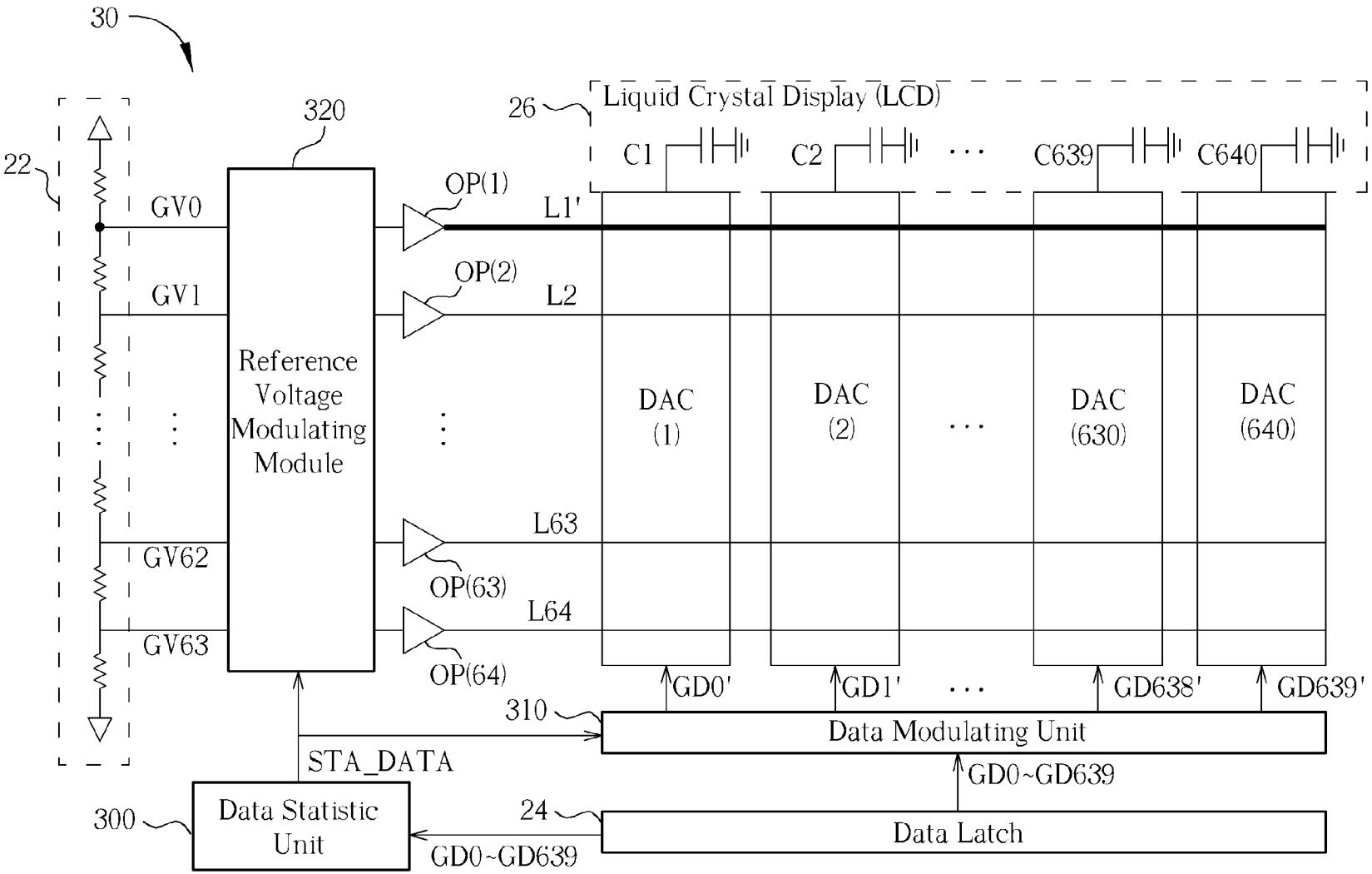
FIG. 3 is a schematic diagram of a source driver of a liquid crystal display (LCD) according to an embodiment of the present invention.

Please refer to FIG. 3, which is a source driver 30 of a liquid crystal display (LCD) monitor according an embodiment of the present invention. The source driver 30 includes a reference voltage generator 22, a data latch 24, Digital to Analog Converters (DACs) DAC(1)-DAC(640), a coupling line L1', coupling lines L2-L64, operational amplifiers (OPs) OP(1)-OP(64), a data statistic unit 300, a data modulating unit 310 and a reference voltage modulating module 320. The source driver 30 can be applied to the data line output circuit 104 of the LCD monitor 10 shown in FIG. 1. Part of components of the source driver 30 is the same as the source driver 20 in FIG. 2, and therefore the same components uses the same names and symbols as the source driver 20. Thus, the source driver 30 selects and outputs respectively the grayscale reference voltages GV0-GV63 to the equivalent capacitance units C1-C640 on the panel 26 through the DACs DAC (1)-DAC (640). The grayscale reference voltages GV0-GV63 correspond to the grayscale levels 0-63, respectively.

In the source driver 30, a width of the coupling line L1' is wider than a width of coupling lines L2-L64 for enhancing the driving ability. Preferably, a width of the coupling line L1' can be selected three times wider than a width of coupling lines L2-L64. The data statistic unit 300 is coupled to the data latch 24 and utilized to statistically calculate the grayscale data values GD0-GD639 corresponding to the equivalent capacitance units C1~C640 to generate a statistic result STA_DATA which indicates a grayscale reference voltage corresponding to the most of the grayscale data values GD0-GD639 and grayscale data value thereof. The data modulating unit 310 is coupled to the data statistic unit 300 and the data latch 24 and, according to the statistic result STA_DATA, adjusts the grayscale data values GD0-GD639 to transmit modulated grayscale data values GD0'-GD639'. The reference voltage modulating module 320 is installed between the data latch 24 and the OPs OP(1)~OP(64) and utilized to adjust transmission relationship between the grayscale reference voltages GV0-GV63 and the coupling lines L1', L2-L64 to transmit the grayscale reference voltage corresponding to the most of the grayscale data values GD0-GD639 through the coupling line L1'. The DACs DAC(1)-DAC(640), according to the modulated grayscale data values GD0'-GD639', select corresponding coupling lines to output corresponding grayscale reference voltages to the equivalent capacitance units C1-C640, respectively. For example, if the modulated grayscale data value GD0' is equal to "0", the DAC (1) selects the coupling line L1'; if the modulated grayscale data value GD0' is equal to "32", the DAC (1) selects the coupling line L33.

By default, the reference voltage modulating module 320 couple the OP (1)-OP (64) to the grayscale reference voltages GV0-GV63, respectively. After the statistic result STA_DATA is generated, the reference voltage modulating module 320 adjusts the transmission relationship between the plurality of coupling lines and the plurality of grayscale reference voltages to have an DAC, which corresponds to a grayscale reference voltage corresponding to the most of plurality of grayscale data values, select the coupling line L1'.

An example (A) is described herein to explain substantially a concept of the present invention. In the example (A), assume that the data latch 24 receives the grayscale data values, wherein GD0-GD9 are equal to "0", GD10-GD19 are equal to "50", GD20-GD615 are equal to "32", GD616-GD625 are equal to "40", and GD626-GD639 are equal to "24". The data statistic unit 300 performs statistic calculation and obtains a result showing that 10 grayscale data values correspond to the grayscale reference voltage GV0, 14 grayscale data values correspond to the grayscale reference voltage GV24, 596 grayscale data values correspond to the grayscale reference voltage GV32, 10 grayscale data values correspond to the grayscale reference voltage GV40, and 10 grayscale data values correspond to the grayscale reference voltage GV50. Thus, the statistic result STA_DATA indicates the grayscale reference voltage GV32 and the grayscale data values GD20-GD615. In this situation, the data modulating unit 310 adjusts the grayscale data values GD0-GD9 from "0" to "32", and the grayscale data values GD20-GD615 from "32" to "0". That is, the modulated grayscale data values GD0'-GD9' are "32", and the modulated grayscale data values GD20'-GD615' are "0". Other modulated grayscale data values are identical with corresponding grayscale data values. Meanwhile, the reference modulation module 320 couple the OP (1) to the grayscale reference voltage GV32, the OP(33) to the grayscale reference voltage GV0, and the rest of the OPs to the default coupling settings. In this situation, the DACs DAC(1)-DAC (10) output the grayscale reference voltage GV0 to the equivalent capacitance units C1~C10 through the coupling line L33, whereas the DAC(21)-DAC(616) output the grayscale reference voltage GV32 to the equivalent capacitance units C21-C616 through the coupling line L1'.

Although 596 DACs simultaneously needs to output the grayscale reference voltage GV32, the coupling line L1' with lower resistance is selected to replace the coupling line L33 for driving the grayscale reference voltage GV32. This enhances the voltage driving ability and reduces load effect of the equivalent capacitance units.

Figure 4:
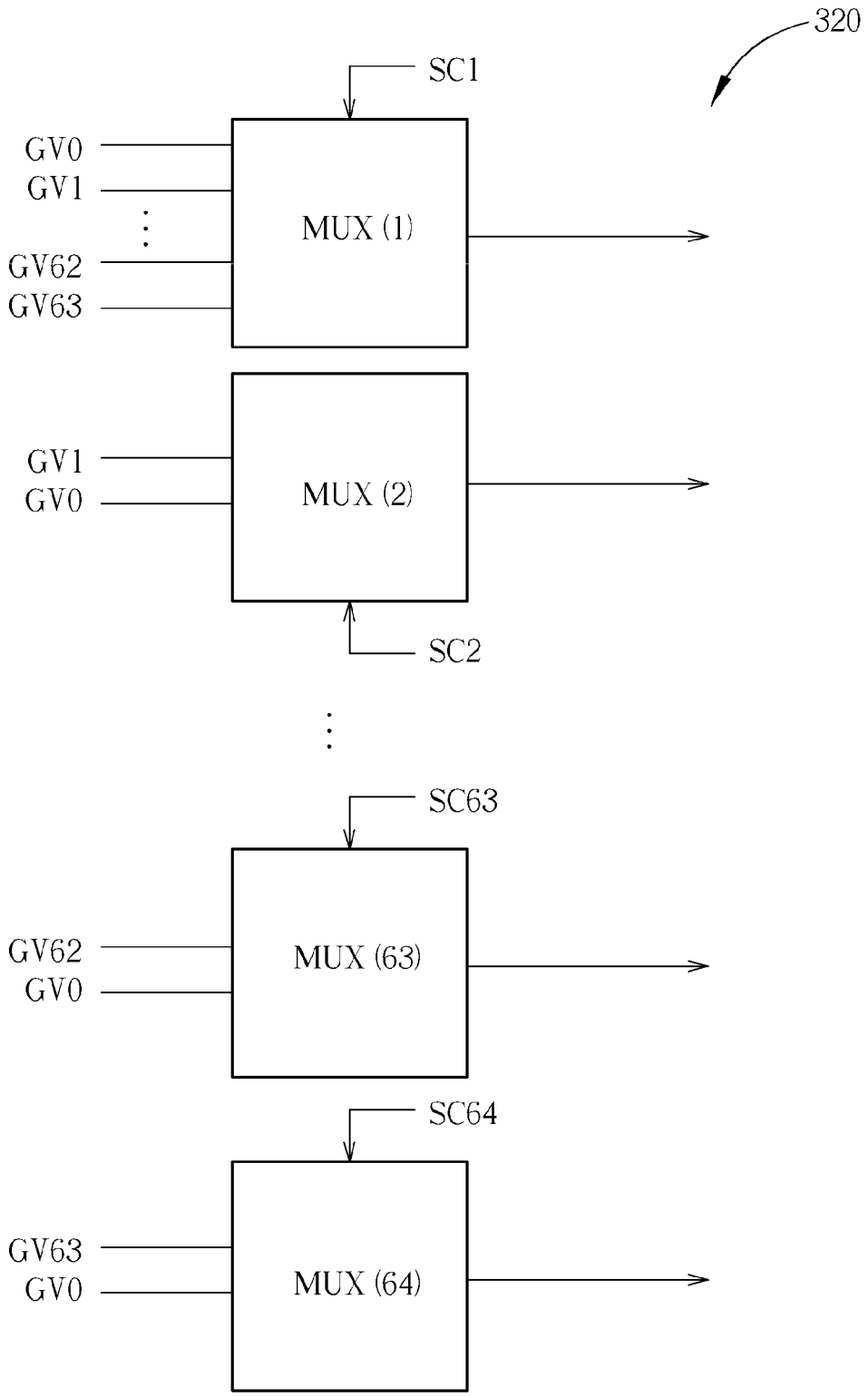
FIG. 4 is a schematic diagram of a reference voltage modulating module of the source driver in FIG. 3 according to an embodiment of the present invention.

Please refer to FIG. 4, which is a schematic diagram of the reference voltage modulating module 320 of the source driver 30 according to an embodiment of the present invention. The reference voltage modulating module 320 includes multiplexers MUX(1)-MUX(64) and is utilized to receive the grayscale reference voltages from input terminals and output a selected grayscale reference voltage to a corresponding OP according to selection signals SC1-SC64. The 64 input terminals of the MUX (1) are used for individually receiving the grayscale reference voltages GV0-GV63. The 2 inputs of the multiplexers MUX (2)-MUX (64) are utilized to individually receive the grayscale reference voltage GV0 and a grayscale reference voltage corresponding to it. The selection signals SC1-SC64 are generated according to the statistic result STA_ DATA.

Please note, the reference voltage modulating module 320 can be installed not only between the data latch 24 and the OPs OP(1)-OP(64) but between the OPs OP(1)-OP(64) and the coupling line L1', L2-L64. In either of the abovementioned arrangements, the reference voltage modulating module 320 has the ability to adjust the transmission relationship between the grayscale reference voltages GV0-GV63 and the coupling line L1', L2-L64.

Figure 5:
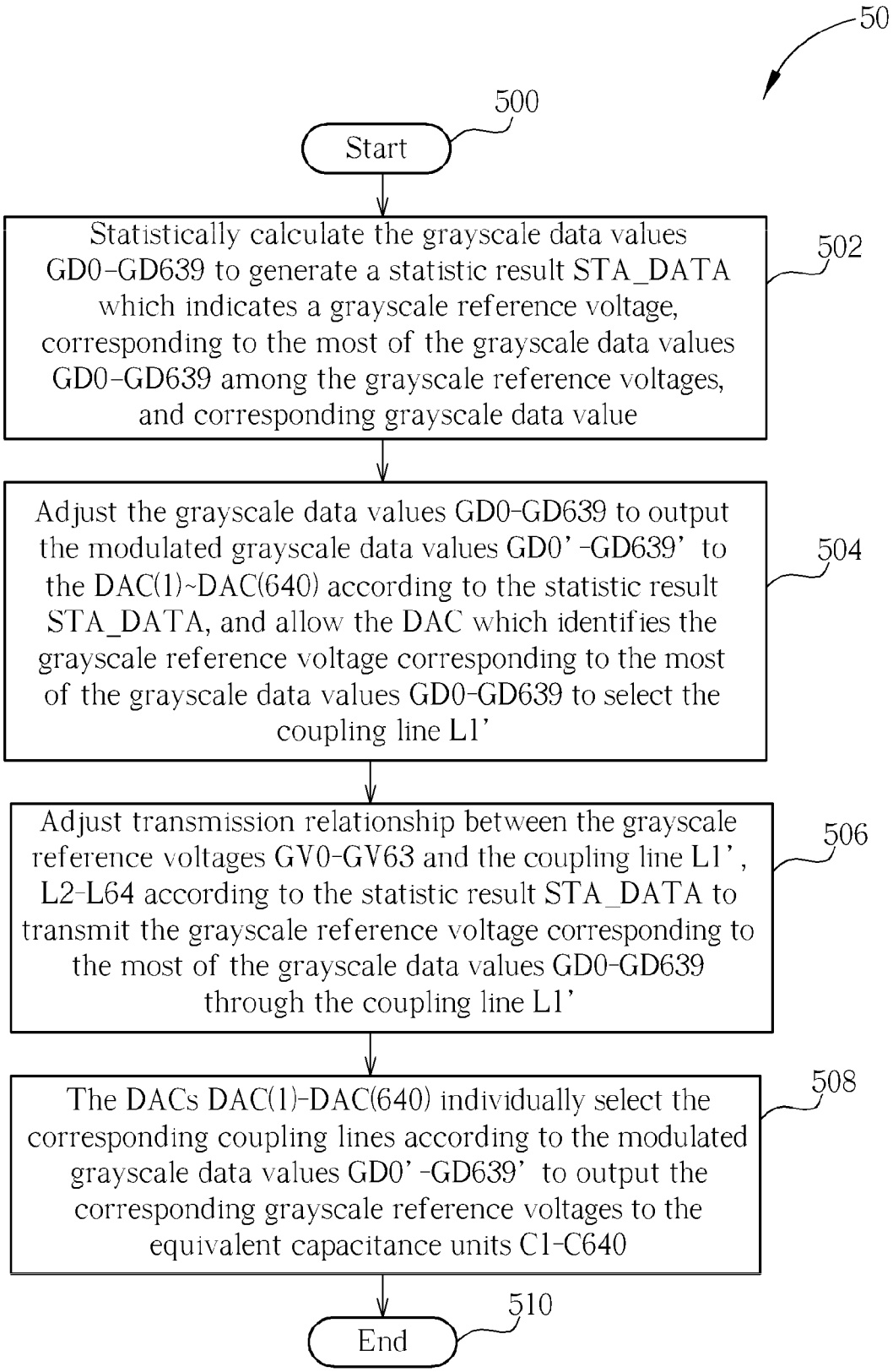
FIG. 5 is a schematic diagram of a flow chart according to an embodiment of the present invention.

Please refer to FIG. 5, which is a flow chart of a process 50 according to an embodiment of the present invention. The process 50 describes an operation flow of the source driver 30 for enhancing grayscale reference voltage driving efficiency. The process 50 includes the following steps:

Step 500: Start.

Step 502: Statistically calculate the grayscale data values GD0-GD639 to generate a statistic result STA_DATA which indicates a grayscale reference voltage, corresponding to the most of the grayscale data values GD0-GD639 among the grayscale reference voltages, and corresponding grayscale data value.

Step 504: Adjust the grayscale data values GD0-GD639 to output the modulated grayscale data values GD0'-GD639' to the DAC(1)~DAC(640) according to the statistic result STA_DATA, and allow the DAC which identifies the grayscale reference voltage corresponding to the most of the grayscale data values GD0-GD639 to select the coupling line L1'.

Step 506: Adjust transmission relationship between the grayscale reference voltages GV0-GV63 and the coupling line L1', L2-L64 according to the statistic result STA_DATA to transmit the grayscale reference voltage corresponding to the most of the grayscale data values GD0-GD639 through the coupling line L1'.

Step 508: The DACs DAC (1)-DAC (640) individually select the corresponding coupling lines according to the modulated grayscale data values GD0'-GD639' to output the corresponding grayscale reference voltages to the equivalent capacitance units C1-C640.

Step 510: End

According to the process 50, the embodiment of the present invention adjusts the grayscale data values GD0-GD639 corresponding to panel pixels and the transmission relationship between the coupling lines and the grayscale reference voltages GV0-GV639 according to the statistic result STA_DATA such that the coupling line L1', with a wider line width, is allowed to transmit the grayscale reference voltage corresponding to the most of the grayscale data values GD0-GD639, thereby reducing the maximum loading for an single OP. Since the process 50 is utilized to realize the operation flow of the source driver 30, the elaborated operations of each step could be referred by the previous description.

Figure 6:
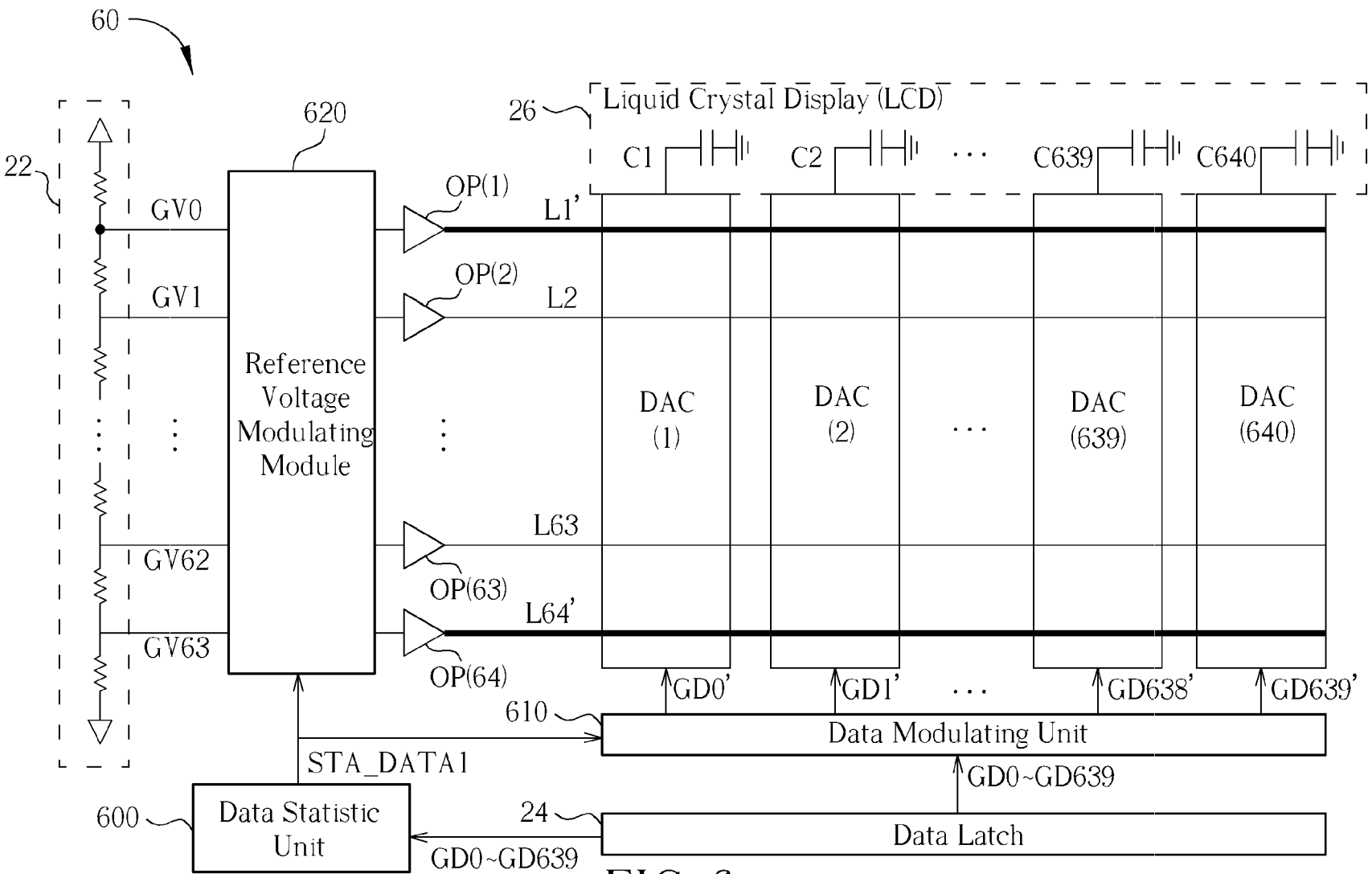
FIG. 6 is a schematic diagram of a source driver of a liquid crystal display (LCD) according to a second embodiment of the present invention.

Please refer to FIG. 6, which is a schematic diagram of a source driver 60 of a LCD monitor. The source driver 60 includes a reference voltage generator 22, a data latch 24, Digital to Analog Converters (DACs) DAC(1)-DAC(640), a coupling line L1', a coupling line L64', coupling lines L2-L63, operational amplifiers OP(1)-OP(64), a data statistic unit 600, a data modulating unit 610 and a reference voltage modulating module 620. The source driver 60 adopts the basic structure of the source driver 30 so the same symbols and names are used to the same components. The coupling line L64' is utilized to replace the coupling line L64 of the source driver 30. A width of the coupling line L64' is wider than widths of coupling lines L2-L63 but narrower than the width of the coupling line L1'. In the source driver 60, the data statistic unit 600 generates a statistic result STA_DATA1 which indicates grayscale reference voltages corresponding to the most and the second most of the grayscale reference data values and corresponding grayscale data values. The indicated grayscale reference voltages are transmitted through the coupling lines L1' and L64'.

Likewise, in the example (A), the statistic result STA_DATA1 indicates that the grayscale reference voltage corresponding to the most of the grayscale reference data values is the grayscale reference voltage GV32 and corresponding grayscale data values are GD20-GD615. Furthermore, the statistic result STA_DATA1 also indicates that the grayscale reference voltage corresponding to the second most of the grayscale reference data values is the grayscale reference voltage GV24 and corresponding grayscale data values are GD626-GD639. Then, the data modulating unit 610 adjusts the grayscale data values GD0-GD9 from "0" to "32", the grayscale data values GD20~GD615 from "32" to "0", and the grayscale data values GD626~GD639 from "24" to "63". On the other hand the reference voltage modulating module 620 couples OP (1) and OP (33) to GV32 and GV0 respectively, OP (64) and OP (25) to GV24 and GV63 respectively. The other OPs are coupled by default. Thus, the DACs DAC (1)-DAC (10) output the grayscale reference voltage GV0 to the equivalent capacitance units C1-C10 through the coupling line L33. The DACs DAC (21)-DAC (616) outputs the grayscale reference voltage GV32 to the equivalent capacitance units C21-C616 through the coupling line L1'. The DAC DAC (627) ~DAC (640) output the grayscale reference voltage GV24 to the equivalent capacitance units C627-C640 through the coupling line L64'.

Figure 7:
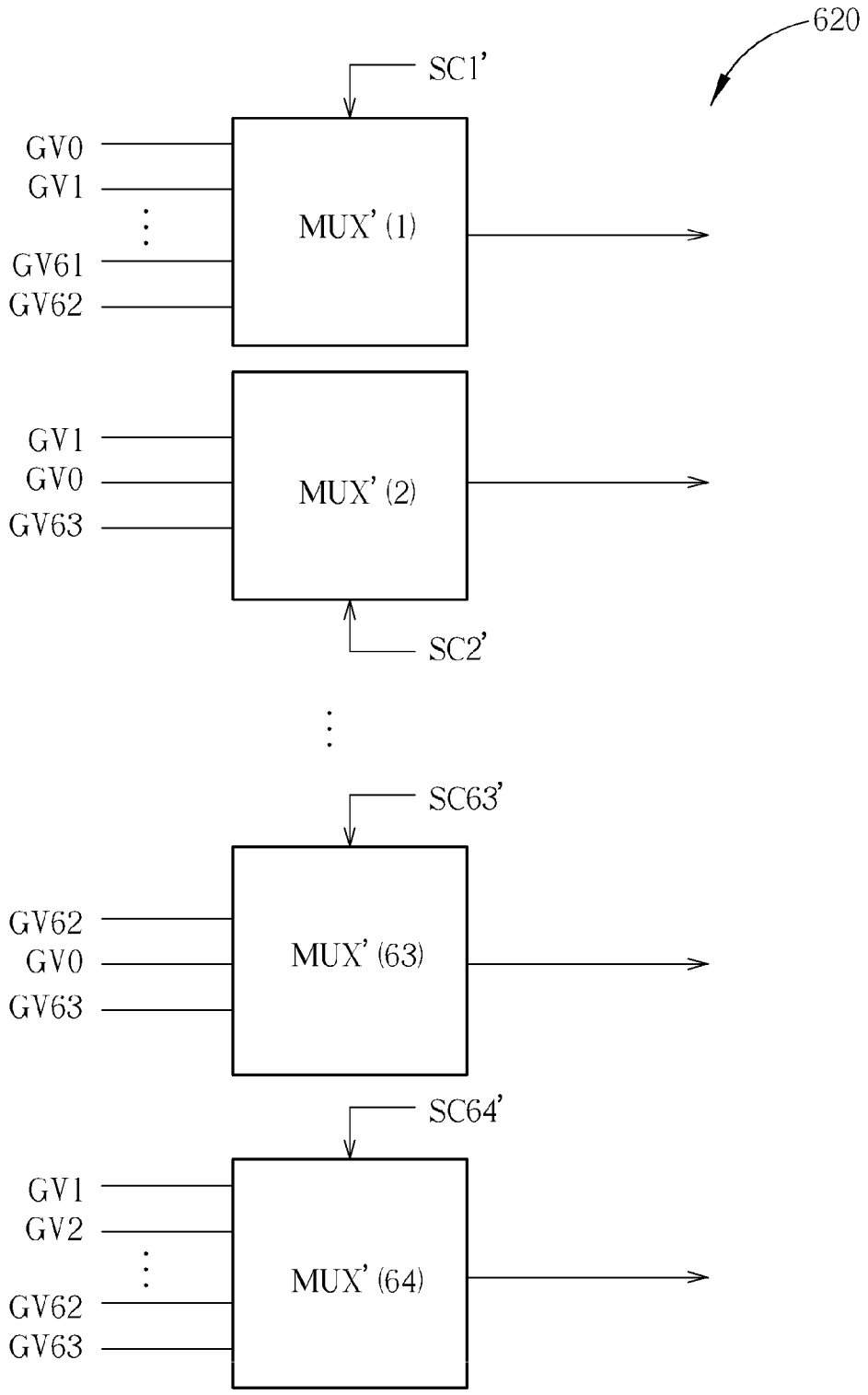
FIG. 7 is a schematic diagram of the reference voltage modulating module of the source driver in FIG. 6.

Please refer to FIG. 7, which is a schematic diagram of the reference voltage modulating module 620 of the source driver 60 according an embodiment of the present invention. The reference voltage modulating module 620 includes multiplexers MUX'(1)~MUX'(64) and is utilized to receive the grayscale reference voltages from input terminals and output a selected grayscale reference voltage to a corresponding OP according to selection signals SC1'-SC64'. 63 input terminals of the MUX' (1) are used for individually receiving the grayscale reference voltages GV0-G62. Similarly, 63 inputs of the MUX' (64) are used for individually receiving the grayscale reference voltages GV1-G63. 3 inputs of the multiplexers MUX' (2)-MUX' (63) are utilized to individually receive GV0, GV63 and the grayscale reference voltage corresponding to itself by default. The selection signals SC1'-SC64' are generated according to the statistic result STA_DATA1.

Note that, according to the embodiment of the present invention, the data modulating unit is a component only designed for the digital to analog converter, and the primary purpose thereof is to allow the DACs to select a correct coupling line. Thus, if the DACs are replaced by any voltage output module which can automatically select a correct coupling line, the data latch 24 can directly output the grayscale data values to the voltage output module without modulation by the data modulating unit. In this situation, the statistic result only needs to indicate a grayscale reference voltage corresponding to the most (or the second most) of the grayscale reference voltages. Besides, usage of wider coupling lines is not restricted to a certain position and amount. Those skilled in the art can determine the position and amount of the wider coupling lines according to circuit board configuration and the number of grayscale levels.

Therefore, according to the embodiments of the present invention, a grayscale reference voltage causing greater loading to the OP is transmitted through a wider (low impedance) coupling line to enhance efficiency of driving the grayscale reference voltages, and further reduce the total charging time for the equivalent capacitance units.

Those skilled in the art will readily observe that numerous modifications and alterations of the device and method may be made while retaining the teachings of the invention.

What is claimed is:

1. An electronic device for enhancing voltage driving efficiency for a source driver of a liquid crystal display (LCD) monitor, the electronic device comprising:

a reference voltage generator for generating a plurality of grayscale reference voltages;

a plurality of first coupling lines, each of the plurality of first coupling lines for transmitting one of the plurality of grayscale reference voltages;

a second coupling line for transmitting one of the plurality of grayscale reference voltages, a width of the second coupling line being wider than a width of each of the plurality of first coupling lines;

a data statistical unit for statistically calculating a plurality of grayscale data values to yield a statistic result which indicates a grayscale reference voltage corresponding to the most of the plurality of grayscale data values among the plurality of grayscale reference voltages; and a reference voltage modulating module coupled between the reference voltage generator and the plurality of first coupling lines and the second coupling line, for adjusting a transmission relationship between the plurality of grayscale reference voltages and the plurality of first coupling lines and the second coupling line according to the statistic result to transmit the grayscale reference voltage corresponding to the most of the plurality of grayscale data values through the second coupling line.

2. The electronic device of claim 1, wherein the reference voltage modulating module comprises a plurality of multiplexers.

3. The electronic device of claim 1, wherein the width of the second coupling line is three times wider than the width of each of the plurality of first coupling lines.

4. The electronic device of claim 1 further comprising:

a data modulating unit for adjusting the plurality of grayscale data values to output a plurality of modulated grayscale data values according to the statistic result; and a voltage output module for selecting one of the plurality of first coupling lines or the second coupling line according to the plurality of modulated grayscale data values.

5. The electronic device of claim 1 further comprising a third coupling line for transmitting one of the plurality of grayscale reference voltages, wherein a width of the third coupling line is wider than the width of each of the plurality of first coupling lines.

6. The electronic device of claim 5, wherein the statistic result further indicates a grayscale reference voltage corresponding to the second most of the plurality of grayscale data values among the plurality of grayscale reference voltages.

7. The electronic device of claim 6, wherein the reference voltage modulating module further adjusts the transmission relationship between the plurality of grayscale reference voltages and the third coupling line according to the statistic result to transmit the grayscale reference voltage corresponding to the second most of the plurality of grayscale data through the third coupling line.

8. The electronic device of claim 6 further comprising:

a data modulating unit for adjusting the plurality of grayscale data values to output a plurality of modulated grayscale data values according to the statistic result; and a voltage output module for selecting one of the plurality of first coupling lines, the second coupling line, or the third coupling line according to the plurality of modulated grayscale data values.

9. The electronic device of claim 5, wherein the width of the second coupling line is equal to the width of the third coupling line.

10. The electronic device of claim 5, wherein the width of the second coupling line is wider than the width of the third coupling line.

11. A method for enhancing voltage driving efficiency for a source driver of a liquid crystal display (LCD) monitor, the method comprising:

providing a plurality of first coupling lines and a second coupling line, each of the plurality of first coupling lines and the second coupling line used for transmitting one of a plurality of grayscale reference voltages, a width of the second coupling line being wider than a width of each of the plurality of first coupling lines;

statistically calculating a plurality of grayscale data values to yield a statistic result indicating a grayscale reference voltage corresponding to the most of the plurality of grayscale data values among the plurality of grayscale reference voltages; and adjusting a transmission relationship between the plurality of grayscale reference voltages and the plurality of first coupling lines and the second coupling line according the statistic result to transmit the grayscale reference voltage corresponding to the most of the plurality of grayscale data values through the second coupling line.

12. The method of claim 11, wherein the width of the second coupling line is three times wider than the width of each of the plurality of first coupling lines.

13. The method of claim 11 further comprising:

adjusting the plurality of grayscale data values to output a plurality of modulated grayscale data values according to the statistic result; and selecting one of the plurality of first coupling lines or the second coupling line according to the plurality of modulated grayscale data values.

14. The method of claim 11 further comprising providing a third coupling line for transmitting one of the plurality of grayscale reference voltages, a width of the third coupling line being three times wider than the width of each of the plurality of first coupling lines.

15. The method of claim 14, wherein the statistic result further indicates a grayscale reference voltage corresponding to the second most of the plurality of grayscale data values among the plurality of grayscale reference voltages.

16. The method of claim 15 further comprising adjusting transmission relationship between the plurality of grayscale reference voltages and the third coupling line according to the statistic result to transmit the grayscale reference voltage corresponding to the second most of the plurality of grayscale data values through the third coupling line.

17. The method of claim 14 further comprising:

adjusting the plurality of grayscale data values to output a plurality of modulated grayscale data values according to the statistic result; and selecting one of the plurality of first coupling lines, the second coupling line, or the third coupling line according to the plurality of modulated grayscale data values.

18. The method of claim 14, wherein the width of the second coupling line is equal to the width of the third coupling line.

19. The method of claim 14, wherein the width of the second coupling line is wider than the width of the third coupling line.

20. A liquid crystal display (LCD) monitor for enhancing voltage driving efficiency, the LCD monitor comprising:

a panel comprising a plurality of equivalent capacitance units and being capable of displaying a plurality of grayscales; and a source driver coupled to the panel, the source driver comprising:

a reference voltage generator for generating a plurality of grayscale reference voltages;

a plurality of operational amplifiers (OPs) for driving the plurality of grayscale reference voltages;

a plurality of first coupling lines, each of the first coupling lines coupled to one of the plurality of Ops, for transmitting one of the plurality of grayscale reference voltages;

a second coupling line coupled to one of the plurality of Ops, for transmitting one of the plurality of grayscale reference voltages, a width of the second coupling line being wider than a width of each of the first coupling lines;

a data statistical unit for statistically calculating the plurality of grayscale data values corresponding to the plurality of equivalent capacitance units to yield a statistic result which indicates a grayscale reference voltage, corresponding to the most of the plurality of grayscale data values among the plurality of grayscale reference voltages, and corresponding grayscale data value;

a data modulating unit coupled to the data statistical unit, for adjusting the plurality of grayscale data values to output a plurality of modulated grayscale data values;

a reference voltage modulating module for adjusting a transmission relationship between the plurality of grayscale reference voltages and the plurality of first coupling lines and the second coupling line according to the statistic result to transmit the grayscale reference voltage corresponding to the most of the plurality of grayscale data values through the second coupling line; and a plurality of digital to analog converters (DACs) coupled in sequence via the plurality of first coupling lines and the second coupling line, each of the plurality of DACs used for selecting one of the plurality of first coupling lines or the second coupling line according to one of the plurality of modulated grayscale data values to output corresponding grayscale reference voltage to one of the plurality of equivalent capacitance units;

wherein, among the plurality of DACs, a DAC corresponding to the grayscale reference voltage corresponding to the most of the plurality of grayscale data values selects the second coupling line according to corresponding grayscale modulated data value.

21. The LCD monitor of claim 20, wherein the reference voltage modulating module is coupled between the reference voltage generator and the plurality of OPs.

22. The LCD monitor of claim 20, wherein the reference voltage modulating module is coupled between the plurality of OPs and the plurality of first coupling lines and the second coupling line.

23. The LCD monitor of claim 20, wherein the reference voltage modulating module comprises a plurality of multiplexers.

24. The LCD monitor of claim 20, wherein the width of the second coupling line is three times wider than the width of one of the plurality of first coupling lines.

25. A liquid crystal display (LCD) monitor for enhancing voltage driving efficiency, the LCD monitor comprising:

a panel comprising a plurality of equivalent capacitance units and being capable of displaying a plurality of grayscales; and a source driver couple to the panel, the source driver comprising:

a reference voltage generator for generating a plurality of grayscale reference voltages;

a plurality of operational amplifiers (Ops) for driving the plurality of grayscale reference voltages;

a plurality of first coupling lines, each of the first coupling lines coupled to one of the plurality of OPs, for transmitting one of the plurality of grayscale reference voltages;

a second coupling line coupled to one of the plurality of OPs, for transmitting one of the plurality of grayscale reference voltages, a width of the second coupling line being wider than a width of each of the first coupling line;

a third coupling line coupled to one of the plurality of OPs, for transmitting one of the plurality of grayscale reference voltages, a width of the third coupling line being wider than the width of each of the first coupling lines;

a data statistical unit for statistically calculating the plurality of grayscale data values corresponding to the plurality of equivalent capacitance units to yield a statistic result which indicates a grayscale reference voltage, corresponding to the most of the plurality of grayscale data values among the plurality of grayscale reference voltages, and corresponding grayscale data value, and a grayscale reference voltage corresponding to the second most of the plurality of grayscale data values among the plurality of grayscale reference voltages and corresponding grayscale data value;

a data modulating unit coupled to the data statistical unit, for adjusting the plurality of grayscale data values to output a plurality of the modulated grayscale data values according to the statistic result;

a reference voltage modulating module for adjusting a transmission relationship between the plurality of grayscale reference voltages and the plurality of first coupling lines, the second coupling line, and the third coupling line according to the statistic result to transmit the grayscale reference voltage corresponding to the most of the plurality of grayscale data values through the second coupling line and the grayscale reference voltage corresponding to the second most of the plurality of grayscale data values through the third coupling line; and a plurality of DACs (Digital to Analog Converters) coupled in sequence via the plurality of first coupling lines, the second coupling line, and the third coupling line, each of the plurality of DACs selecting one of the plurality of first coupling lines, the second coupling line, or the third coupling line according to one of the plurality of modulated grayscale data values to output corresponding grayscale reference voltage to one of the plurality of equivalent capacitance units;

wherein, among the plurality of DACs, a DAC, corresponding to the grayscale reference voltage corresponding to the most of the plurality of grayscale data values, selects the second coupling line according to corresponding modulated grayscale data value, and a DAC, corresponding to the grayscale reference voltage corresponding to the second most of the plurality of grayscale data values, selects the third coupling line according to corresponding modulated grayscale data value.

26. The LCD monitor of claim 25, wherein the reference voltage modulating module is coupled between the reference voltage generator and the plurality of OPs.

27. The LCD monitor of claim 25, wherein the reference voltage modulating module is coupled between the plurality of OPs and the plurality of first coupling lines, the second coupling line, and the third coupling line.

28. The LCD monitor of claim 25, wherein the reference voltage modulation module comprising a plurality of multiplexers.

29. The LCD monitor of claim 25, wherein the width of the second coupling line is three times wider than the width of each of the plurality of first coupling lines.

30. The LCD monitor of claim 25, wherein the width of the second coupling line is equal to the width of the third coupling line.

31. The LCD monitor of claim 25, wherein the width of the second coupling line is wider than the width of the third coupling line.

* * * * *